US010352649B2

(12) United States Patent
Beaty et al.

(10) Patent No.: US 10,352,649 B2
(45) Date of Patent: Jul. 16, 2019

(54) MODULAR HANDGUARD

(71) Applicants: David L. Beaty, Mesa, AZ (US); Jason Butkowski, Glendale, AZ (US)

(72) Inventors: David L. Beaty, Mesa, AZ (US); Jason Butkowski, Glendale, AZ (US)

( * ) Notice: Subject to any disclaimer, the term of this patent is extended or adjusted under 35 U.S.C. 154(b) by 0 days.

(21) Appl. No.: 15/605,834

(22) Filed: May 25, 2017

(65) Prior Publication Data

US 2017/0343315 A1 Nov. 30, 2017

Related U.S. Application Data

(60) Provisional application No. 62/341,538, filed on May 25, 2016.

(51) Int. Cl.
*F41C 23/16* (2006.01)

(52) U.S. Cl.
CPC ..... *F41C 23/16* (2013.01)

(58) Field of Classification Search
CPC ..... F41C 23/16
USPC ..... 42/71.01
See application file for complete search history.

(56) References Cited

U.S. PATENT DOCUMENTS

| | | | | |
|---|---|---|---|---|
| 5,343,650 | A * | 9/1994 | Swan | F41C 23/16 42/117 |
| 8,726,558 | B1 * | 5/2014 | Nason | F41C 23/16 42/71.01 |
| 9,464,866 | B1 * | 10/2016 | Liang | F41C 23/16 |
| 2010/0154280 | A1 * | 6/2010 | LaFrance | F41G 11/001 42/124 |
| 2013/0205636 | A1 * | 8/2013 | Shull | F41C 23/04 42/72 |
| 2014/0157640 | A1 * | 6/2014 | Whelan | F41C 23/16 42/75.02 |

* cited by examiner

*Primary Examiner* — Bret Hayes
(74) *Attorney, Agent, or Firm* — Schmeiser, Olsen & Watts LLP

(57) ABSTRACT

A free float modular handguard is provided. The handguard includes a mounting adapter having an aperture and a barrel nut having an aperture. The barrel nut couples the mounting adapter to an upper receiver of a firearm through the aperture of the mounting adapter. The aperture of the barrel nut receives a barrel therethrough. The handguard also includes a support member having an aperture. The support member is aligned with the aperture of the barrel nut, wherein the aperture of the support member receives the barrel therethrough. The handguard also includes a top member, a bottom member, a first side member, and a second side member, wherein the top member, bottom member, first side member and second side member are each coupled on one end to the mounting adapter coupled on the other end the support member. This creates the free float modular handguard.

15 Claims, 3 Drawing Sheets

MODULAR HANDGUARD

CROSS REFERENCE TO RELATED APPLICATION[S]

This application claims priority to U.S. Provisional Patent Application entitled "MODULAR RIFLE HANDGUARD," Ser. No. 62/341,538, filed May 25, 2016, the disclosure of which is hereby incorporated entirely herein by reference.

BACKGROUND OF THE INVENTION

Technical Field

This invention relates generally to a firearm handguard and more particularly to a modular handguard for a firearm.

State of the Art

The handguard is a part of a firearm, such as a rifle or handgun that provides a protection to the user. The handguard protects the user from the barrel, which can get very hot during use. Additionally, there exists handguards that are referred to as free float handguards that are attached to the upper receiver on end and unsupported on the opposing end. These free float handguards include systems for attaching various accessories, such as rails, handles, sights, lasers, flashlights and the like. However, these handguards are always configured according to how the manufacturer makes the handguard. They are not truly modular or customizable.

Accordingly, there is a need in the field of hand guards for an improved modular free float handguard.

DISCLOSURE OF THE INVENTION

The present invention relates to a free float modular handguard that may be user configurable.

An embodiment includes a free float modular handguard comprising: a mounting adapter having an aperture through a body of the mounting adapter; a barrel nut having an aperture, wherein the barrel nut couples to an upper receiver of a firearm through the aperture of the mounting adapter to couple the mounting adapter to the upper receiver and the aperture of the barrel nut receives a barrel therethrough; a first support member having an aperture, wherein the aperture of the first support member is aligned with the aperture of the barrel nut, wherein the aperture of the first support member receives the barrel therethrough; a top member, a bottom member, a first side member, and a second side member, wherein the top member, bottom member, first side member and second side member are each coupled on a first end to the mounting adapter and coupled on a second end to the first support member.

Another embodiment includes a free float modular handguard comprising: a mounting adapter having an aperture through a body of the mounting adapter; a barrel nut having an aperture, wherein the barrel nut couples to an upper receiver of a firearm through the aperture of the mounting adapter to couple the mounting adapter to the upper receiver and the aperture of the barrel nut receives a barrel therethrough; a first support member having an aperture, wherein the aperture the support member is aligned with the aperture of the barrel nut, wherein the aperture of the first support member receives the barrel therethrough; a second support member having an aperture, wherein the aperture the second support member is aligned with the aperture of the barrel nut, wherein the aperture of the second support member receives the barrel therethrough; a top member, a bottom member, a first side member, and a second side member, wherein the top member, bottom member, first side member and second side member are each coupled on a first end to the mounting adapter, coupled on a second end to the first support member, and coupled on a center portion to the second support member.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
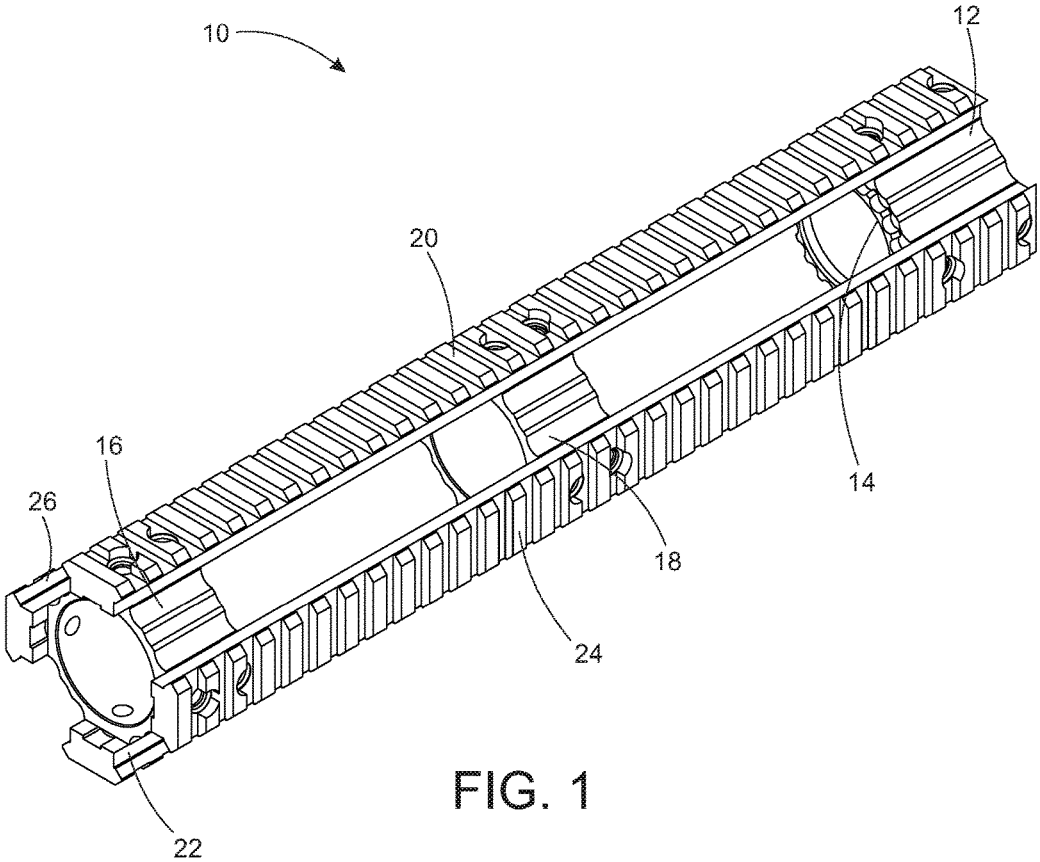
FIG. 1 is a perspective view of a modular free float handguard, in accordance with embodiments.
Figure 2:
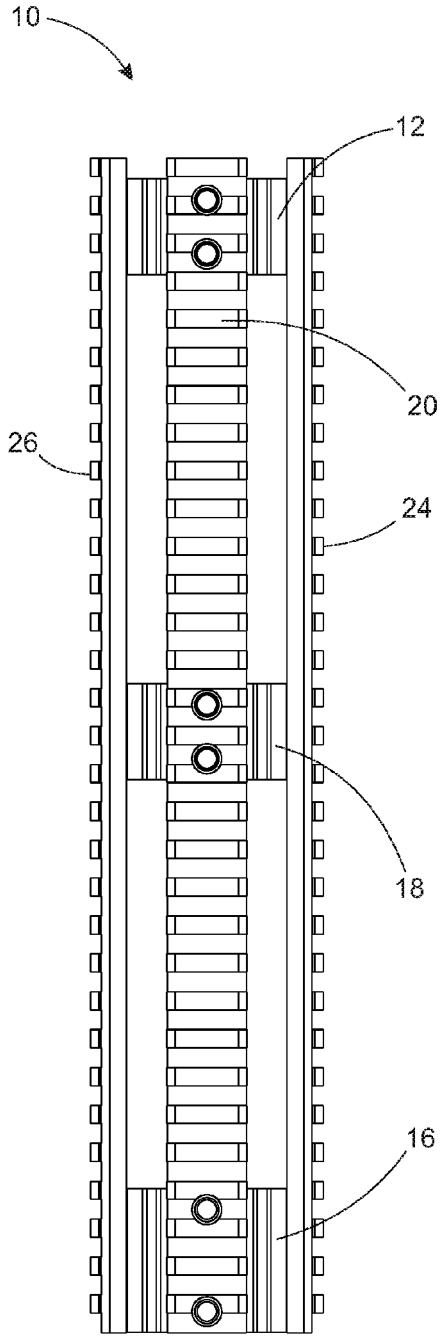
FIG. 2 is a top view of a modular free float handguard, in accordance with embodiments.
Figure 3:
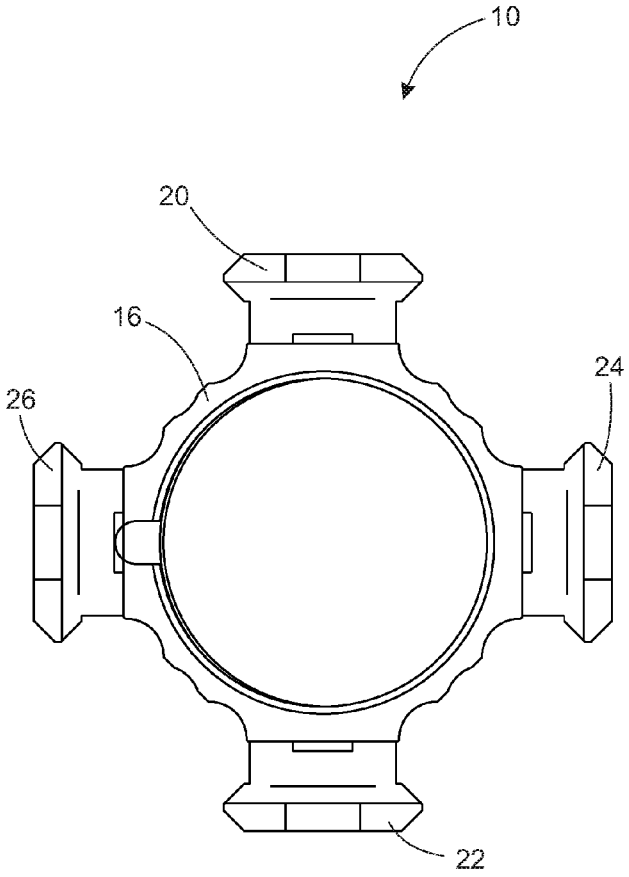
FIG. 3 is an end view of a modular free float handguard, in accordance with embodiments.

Embodiments of the present invention relate to a free float modular handguard that may be user configurable.

As shown in FIGS. 1-4, a free float modular handguard 10 is depicted in accordance with embodiments of the present invention. The handguard 10 may include a mounting adapter 12, a barrel nut 14, a first support member 16, a top member 20, a bottom member 22, a first side member 24 and a second side member 26. The mounting adapter 12 has an aperture through a body of the mounting adapter 12. The barrel nut 14 has an aperture, wherein the barrel nut 14 couples to an upper receiver of a firearm (not shown) through the aperture of the mounting adapter 12 to couple the mounting adapter 12 to the upper receiver. The aperture of the barrel nut 14 receives a barrel (not shown) therethrough. The barrel nut 14 also includes thread used to couple the mounting adapter 12 to the barrel nut 14 and threads to couple to the upper receiver.

The top member 20, bottom member 22, first side member 24 and second side member 26 may each be coupled on a first end to the mounting adapter 12. As depicted in the FIG. 4, the top member 20, bottom member 22, first side member 24 and second side member 26 each have a recess 30 at the first end that corresponds with protrusions 40 formed on the mounting adapter 12 and extend radially from an outer surface. The protrusions 40 are inserted within recesses 30 and a coupling device, such as a bolt, screw or the like is used to couple the first end of the top member 20, bottom member 22, first side member 24 and second side member 26 to the mounting adapter 12. In embodiments, the protrusions 40 may be equally spaced apart around the mounting adapter 12.

A second end of the top member 20, bottom member 22, first side member 24 and second side member 26 may be coupled to a first support member 16. As depicted in the FIG. 4, the top member 20, bottom member 22, first side member 24 and second side member 26 each have a recess 32 at the second end that corresponds with protrusions 42 formed on the first support member 16 and extend radially from an outer surface. The protrusions 42 are inserted within recesses 32 and a coupling device, such as a bolt, screw or the like is used to couple the second end of the top member 20, bottom member 22, first side member 24 and second side member 26 to the first support member 16. In embodiments, the protrusions 42 may be equally spaced apart around the first support member 16. The first support member 16 includes an aperture, wherein the barrel of the firearm may extend through the aperture, thus creating a free float handguard 10.

A center portion of the top member 20, bottom member 22, first side member 24 and second side member 26 may be coupled to a second support member 18. As depicted in the FIG. 4, the top member 20, bottom member 22, first side member 24 and second side member 26 each have a recess 34 at the center portion that corresponds with protrusions 44 formed on the second support member 18 and extend radially from an outer surface. The protrusions 44 are inserted within recesses 34 and a coupling device, such as a bolt, screw or the like is used to couple the second end of the top member 20, bottom member 22, first side member 24 and second side member 26 to the second support member 16. In embodiments, the protrusions 44 may be equally spaced apart around the second support member 18. The second support member 18 includes an aperture, wherein the barrel of the firearm may extend through the aperture, thus creating a free float handguard 10.

In embodiments, the top member 20, bottom member 22, first side member 24 and second side member 26 may be coupled to the mounting adapter 12, the first support member 16 and/or the second support member 18 such that the top member 20 is substantially parallel with the bottom member 22 and the first side member 24 is substantially parallel to the second side member 26. Further, in this configuration, the top member 20 is substantially perpendicular to the first side member 24 and the second side member 26 and the bottom member 22 is likewise substantially perpendicular to the first side member 24 and the second side member 26. It should be understood that other configurations of the top member 20, bottom member 22, first side member 24 and second side member 26 may be oriented at any angle with respect to one another, may include one or more of the top member 20, bottom member 22, first side member 24 and second side member 26, and/or any configuration wherein the members are coupled between the mounting adapter 12 and the first support member 16.

Figure 4:
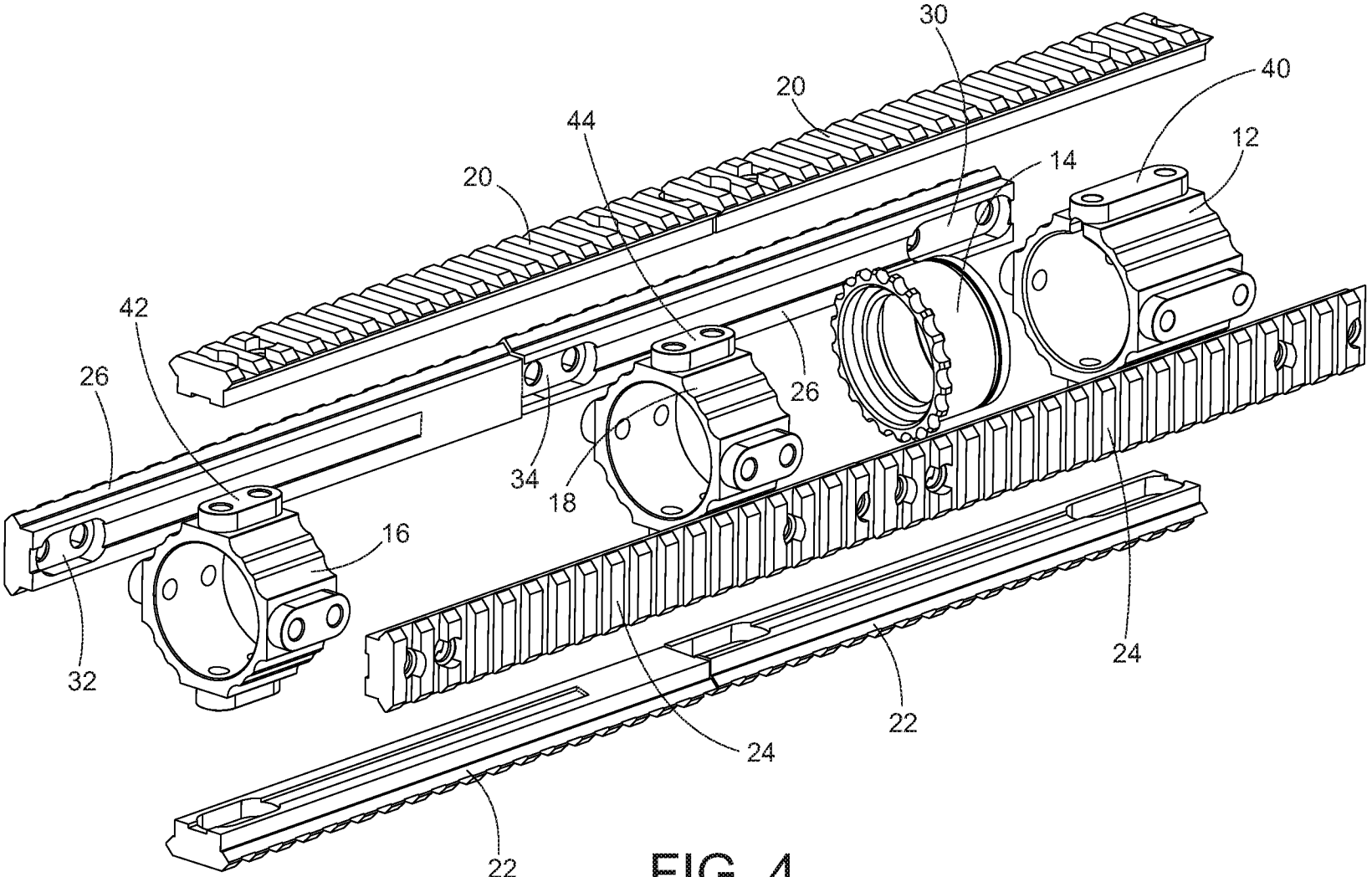
FIG. 4 is an exploded perspective view of a modular free float handguard, in accordance with embodiments.

As shown in FIGS. 1-4, the top member 20, bottom member 22, first side member 24 and second side member 26 are each depicted as rails, such as a Picatinny rail. However, it will be understood that other types of structures may form the top member 20, bottom member 22, first side member 24 and second side member 26, such as flat smooth surfaced members, members with handles, members with sights, members with attachment systems to attach other accessories and the like. Each of the top member 20, bottom member 22, first side member 24 and second side member 26 may be the same, or may also different in the style, shape, or type of structure that it forms. Additionally, each of the top member 20, bottom member 22, first side member 24 and second side member 26 may be the same, or may also be different lengths, widths, heights, and/or thicknesses according to user preference for mounting different accessories or handling the firearm itself. A non-limiting example may be to use a taller top member 20 than a bottom member 22, first side member 24, and second side member 26 to mount a scope or other optic accessory so that the user may more comfortably look through the scope or other optic accessory. Additionally, as shown in FIG. 4, the top member 20, bottom member 22, first side member 24 and second side member 26, in some embodiments, may include more than one member, such as two members as shown.

It is also to be understood that the handguard may be composed of members of different shapes according to the preference of the user. Some non-limiting examples of shapes that may be used are: semi-circular, so that when each member is assembled it creates a substantially round handguard; and rectangular, so that when each member is assembled it creates a generally box-shaped handguard. Further, a user may assemble components of different shapes to create a custom shaped handguard such as triangular, semi-circular, etc., according to the needs and preferences of each user. This allows for a truly modular free float handguard.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A free float modular handguard comprising:

a mounting adapter having an aperture through a body of the mounting adapter;

a barrel nut having an aperture, wherein the barrel nut couples to an upper receiver of a firearm through the aperture of the mounting adapter to couple the mounting adapter to the upper receiver and the aperture of the barrel nut receives a barrel therethrough;

a first support member having an aperture, wherein the aperture of the first support member is aligned with the aperture of the barrel nut, wherein the aperture of the first support member receives the barrel therethrough; and a top member, a bottom member, a first side member, and a second side member are each coupled on a first end to the mounting adapter, and wherein each of the top member, the bottom member, the first side member, and the second side member are coupled on a second end to the first support member.

2. The handguard of claim 1, wherein the mounting adapter has at least four protrusions extending radially from an outer surface and the first support member has at least four protrusions extending radially from an outer surface.

3. The handguard of claim 2, wherein the top member, the bottom member, the first side member, and the second side member each have a recess formed in a first side and a second side thereof, wherein each recess receives one protrusion of the mounting adapter within the recess when coupling the first end of the top member, the bottom member, the first side member, and the second side member to the mounting adapter and one protrusion of the first support member within the recess when coupling the second end of the top member, the bottom member, the first side member, and the second side member to the first support member.

4. The handguard of claim 1, wherein the top member is substantially parallel with the bottom member and the first side member is substantially parallel to the second side member.

5. The handguard of claim 4, wherein the top member is substantially perpendicular to the first side member and the second side member and the bottom member is substantially perpendicular to the first side member and the second side member.

6. A free float modular handguard comprising:

a mounting adapter having an aperture through a body of the mounting adapter;

a barrel nut having an aperture, wherein the barrel nut couples to an upper receiver of a firearm through the aperture of the mounting adapter to couple the mounting adapter to the upper receiver and the aperture of the barrel nut receives a barrel therethrough;

a first support member having an aperture, wherein the aperture of the support member is aligned with the aperture of the barrel nut, wherein the aperture of the first support member receives the barrel therethrough;

a second support member having an aperture, wherein the aperture of the second support member is aligned with the aperture of the barrel nut, wherein the aperture of the second support member receives the barrel therethrough;

a top member, a bottom member, a first side member, and a second side member, wherein the top member, bottom member, first side member and second side member are each coupled on a first end to the mounting adapter, coupled on a second end to the first support member, and coupled on a center portion to the second support member.

7. The handguard of claim 6, wherein the mounting adapter has at least four protrusions extending radially from an outer surface.

8. The handguard of claim 7, wherein the top member, the bottom member, the first side member, and the second side member each have a recess formed in at the first side, wherein each recess receives one protrusion within the recess when coupling the first end of the top member, the bottom member, the first side member, and the second side member to the mounting adapter.

9. The handguard of claim 6, wherein the first support member has at least four protrusions extending radially from an outer surface.

10. The handguard of claim 9, wherein the top member, the bottom member, the first side member, and the second side member each have a recess formed in at the second side, wherein each recess receives one protrusion within the recess when coupling the second end of the top member, the bottom member, the first side member, and the second side member to the first support member.

11. The handguard of claim 6, wherein the second support member has at least four protrusions extending radially from an outer surface.

12. The handguard of claim 11, wherein the top member, the bottom member, the first side member, and the second side member each have a recess formed in at the center portion, wherein each recess receives one protrusion within the recess when coupling the center portion of the top member, the bottom member, the first side member, and the second side member to the second support member.

13. The handguard of claim 6, wherein the top member is substantially parallel with the bottom member and the first side member is substantially parallel to the second side member.

14. The handguard of claim 13, wherein the top member is substantially perpendicular to the first side member and the second side member and the bottom member is substantially perpendicular to the first side member and the second side member.

15. A free float modular handguard comprising:

a mounting adapter having an aperture through a body of the mounting adapter;

a barrel nut having an aperture, wherein the barrel nut couples to an upper receiver of a firearm through the aperture of the mounting adapter to couple the mounting adapter to the upper receiver and the aperture of the barrel nut receives a barrel therethrough;

a first support member having an aperture, wherein the aperture of the first support member is aligned with the aperture of the barrel nut, wherein the aperture of the first support member receives the barrel therethrough; and a combination of at least two of the group that includes a top member, a bottom member, a first side member, and a second side member, wherein each member of the combination is coupled on a first end to the mounting adapter and coupled on a second end to the first support member.

* * * * *